US007872196B2

(12) United States Patent
Harada

(10) Patent No.: US 7,872,196 B2
(45) Date of Patent: Jan. 18, 2011

(54) ELECTRICAL COMPONENT BOX FOR WATER VEHICLE

(75) Inventor: Naoki Harada, Hamamatsu (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 433 days.

(21) Appl. No.: 11/949,574

(22) Filed: Dec. 3, 2007

(65) Prior Publication Data

US 2008/0264666 A1 Oct. 30, 2008

(30) Foreign Application Priority Data

Dec. 1, 2006 (JP) ..... 2006-326125

(51) Int. Cl.
*H05K 5/06* (2006.01)

(52) U.S. Cl. ..... 174/50; 174/58; 174/64; 439/701; 248/906

(58) Field of Classification Search ..... 174/50, 174/58, 64; 439/76.2, 364, 701; 220/4.02; 248/906

See application file for complete search history.

(56) References Cited

U.S. PATENT DOCUMENTS 6,126,458 A * 10/2000 Gregory et al. ..... 439/76.2
6,515,226 B2 * 2/2003 Chiriku et al. ..... 174/50
6,541,700 B2 * 4/2003 Chiriku et al. ..... 174/50
6,545,861 B1 * 4/2003 Hayes et al. ..... 361/642

FOREIGN PATENT DOCUMENTS

JP 2003-040198 2/2003

* cited by examiner

*Primary Examiner*—Dhiru R Patel
(74) *Attorney, Agent, or Firm*—Keating & Bennett, LLP

(57) ABSTRACT

An electrical component box which can be provided under a maintenance opening in an engine compartment on a water vehicle, can include a box body provided with an electrical unit and a cover member. The box body can be attached to a bulkhead so that a mounting surface for an electrical unit extends generally vertically. Engaging frames can be provided on the upper face of the box body. Also, engaging clamps can be provided on the upper side of the cover member to be engaged with the engaging frames by one-touch operation. A bottom cover can be provided under the box body to cover the bottom side of the electrical unit and the upper side, both lateral sides and the front side of the electrical unit can be covered by the cover member.

13 Claims, 22 Drawing Sheets

ELECTRICAL COMPONENT BOX FOR WATER VEHICLE

PRIORITY INFORMATION

The present application is based on and claims priority under 35 U.S.C. §119(a-d) to Japanese Patent Application No. 2006-326125, filed on Dec. 1, 2006, the entire contents of which is expressly incorporated by reference herein.

BACKGROUND OF THE INVENTIONS

1. Field of the Inventions

The present inventions relate to electrical component boxes, such as, for example, electrical component boxes provided under a maintenance opening in an engine compartment of a water vehicle.

2. Description of the Related Art

Known water vehicles use various electrical components for controlling various devices, such as an engine. These electrical components are often contained in a waterproof electrical component box disposed, for example, in an engine compartment. For example, Japanese Patent Document JP-A-2003-040198 discloses an electrical component box with a deep rectangular box body and a cover which closes an opening of the box body with a seal member in a watertight manner. The side wall of the box body includes a plurality of threaded holes engaged with screws for securing the cover to the box body. The electrical component box is attached to a bulkhead, which forms the division between the engine compartment and a pump compartment in the watercraft.

SUMMARY OF THE INVENTIONS

The conventional electrical component box described above is constructed such that the cover is attached to the box body by screws, which can provide a secure and reliable connection between the body and the cover. However, when maintenance for electrical components contained inside the box is performed, the cover needs to be removed from the box body by unscrewing screws with a tool such as a screwdriver. As a result, a space for using such tools is required around the front side or the lateral side of the electrical component box, which, in turn, requires the engine compartment to accommodate the use of the tools, and/or limits the positions in which the screws can be placed on the box.

In a small watercraft like a water vehicle having a small engine compartment, it is difficult to provide sufficient space around the electrical component box and therefore a larger hull is required to secure the space. Also, when a service personnel maintains electrical components, he or she has difficulties during maintenance in that he or she needs to look into the engine compartment to do maintenance through an opening disposed in the upper part of the engine compartment, he or she needs to work in the darkness in the engine compartment or he or she needs to find and pick up screws or bolts if they are fallen off in the engine compartment.

An aspect of at leas one of the embodiments disclosed herein includes the realization that components inside an engine compartment can be arranged more tightly and thus, such an engine compartment can be made smaller if a device such as an electrical box, is held closed by fastening arrangements that do not require tools like a screw driver.

Thus, in accordance with an embodiment, an electrical component box provided under a maintenance opening in an engine compartment on a water vehicle, can be provided. The box can comprise a box body which is attached to an attaching base in the engine compartment with its mounting surface, on which an electrical unit is mounted, extending generally vertically, the box body being provided with engaged portions at predetermined parts. A cover member for covering the mounting surface on which the electrical unit is mounted in the box body, the cover member being provided with engaging portions at predetermined parts to be engaged with the engaged portions. Additionally, when, the cover member is moved downward from an upper position of the box body to cover the mounting surface for the electrical unit and to be fixed onto the box body by movement of the engaging portions with the engaged portions toward each other.

In accordance with another embodiment, an electrical component box for a vehicle can comprise a box body comprising a mounting surface and an electrical unit mounted to the mounting surface, the box body being provided with engaged portions at predetermined positions. A cover member can be configured to cover the electrical unit, the cover member being provided with engaging portions at predetermined positions and arranged to engage with the engaged portions. Additionally, the engaging portions and the engaged portions can be arranged such that when the cover member is moved downwardly from an upper position, the engaged and engaging portions move toward and engage with each other.

In accordance with yet another embodiment, an electrical component box for a vehicle can comprise a box body comprising a mounting surface, an electrical unit mounted to the mounting surface, and an opening facing toward a generally horizontal direction. A cover member can be configured to cover the electrical unit. Additionally, means can be provided for attaching the cover and the box body in a watertight manner without tools, wherein movement of the cover member downwardly relative to the opening causes engagement between the cover member and the box body.

BRIEF DESCRIPTION OF THE DRAWINGS

The above-mentioned and other features of the inventions disclosed herein are described below with reference to the drawings of preferred embodiments. The illustrated embodiments are intended to illustrate, but not to limit the inventions. The drawings contain the following Figures.

DETAILED DESCRIPTION OF THE PREFERRED EMBODIMENT

Figure 1:
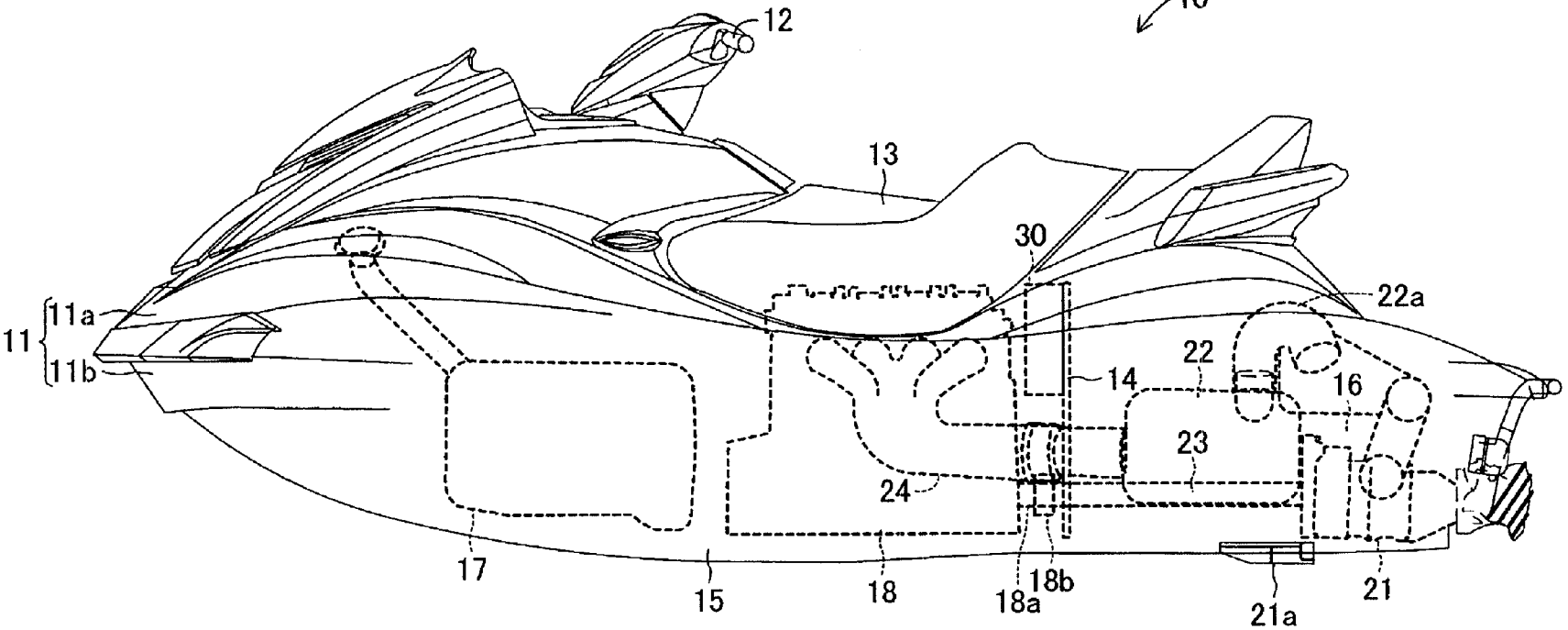
FIG. 1 is a side elevational view of a water vehicle having an electrical component box according to an embodiment.

FIG. 1 illustrates a small water vehicle 10 having an electrical component box 30 in accordance with several embodiments. The various embodiments of the electrical component box 30 are disclosed in the context of a small water vehicle because it has particular utility in this context. However, the electrical component boxes disclosed herein can be used in other contexts, such as, for example, but without limitation, outboard motors, inboard/outboard motors, and for engines of other vehicles including land vehicles.

Figure 2:
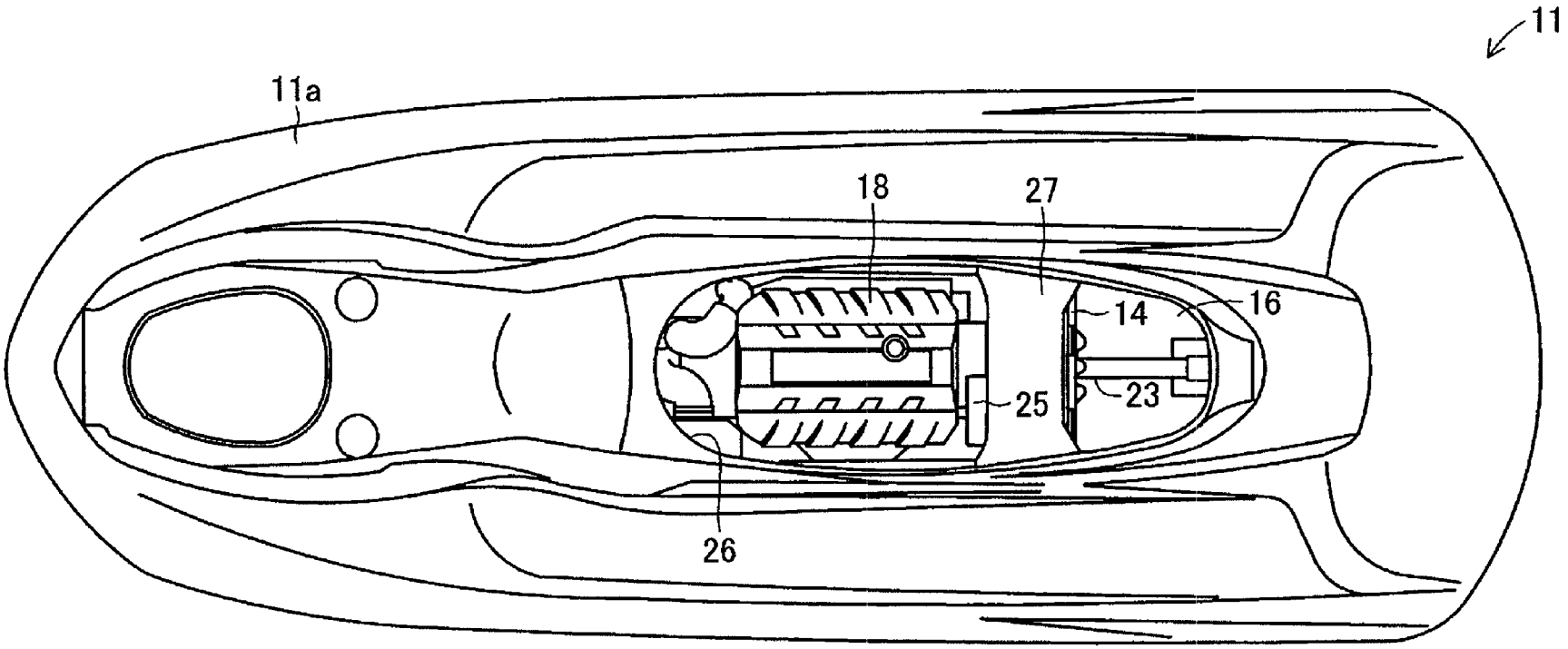
FIG. 2 is a top plan view of the water vehicle in FIG. 1.

With continued reference to FIGS. 1 and 2, the water vehicle 10 can have a body 11 including a deck 11*a* and a hull 11*b*. The body 11 can have steering handlebars 12 on its upper part approximately at the center in its lateral direction, as well as a seat 13 in the rear of the handlebars. FIG. 2 shows a top plan view of the water vehicle 10 with the handlebars 12, front hatch cover, and the seat 13 removed from the body 11.

A bulkhead 14 can be used to form a rear wall of an engine compartment positioned slightly rearward with respect to a body center. The bulkhead 14 can divide the inside of the body 11 into front side and rear side compartments. The front side of the bulkhead 14 can constitute the engine compartment 15 and the rear side of the bulkhead 14 can constitute a pump compartment 16 in the inside of the body 11. However, other configurations can also be used.

In the engine compartment 15, a fuel tank 17, an engine 18 and the like can be disposed. In the pump chamber 16, a propulsion unit 21, a water lock 22 and the like can be disposed. However, other configurations can also be used.

A crankshaft 18*a* extend rearwardly from the rear part of the engine 18. An impeller shaft 23 can be coupled to the crankshaft 18*a* via a coupling 18*b* provided at the rear end of the crankshaft 18*a*.

The impeller shaft 23 can extend rearwardly through the bulkhead 14 into the pump compartment 16 and can be coupled to the impeller (not shown) provided in the inside of the propulsion unit 21 mounted to the stern of the body 11. As such, the impeller shaft 23 can transmit a rotational force of the crankshaft 18*a* driven by the engine 18 to rotate the impeller. In some embodiments, the impeller shaft 23 can be formed from a single member, or it can be formed from several shaft parts connected together, for example, but without limitation, by splined connections.

The propulsion unit 21 can have a water inlet port 21*a* that opens in the bottom portion of the body 11 and a water outlet port (not shown) that opens in the stern. During operation, by jetting out sea water introduced through the water inlet port 21*a* from the water outlet port by the rotation of the impeller, a propulsion force is imparted to the body 11.

The propulsion unit 21 can be installed at the bottom at the stern of the body 11, while separated by a casing (not shown) from the main part of the body 11. The impeller shaft 23 can pass through the casing to extend from the engine 18 side to the propulsion unit 21. However, other configurations can also be used.

With continued reference to FIG. 1, at the rear of the engine 18 can be provided an exhaust system. The exhaust system can include an exhaust manifold 24 including a bent pipe, a tank-shaped water lock 22 and the like. The exhaust manifold 24 can extend rearwardly through the bulkhead 14 from the lateral side of the engine 18. The rear end of the exhaust manifold 24 can be connected to the front part of the water lock 22.

An exhaust pipe 22*a* can extend rearwardly from a rear upper surface of the water lock 22. The exhaust pipe 22*a* can firstly extend upwardly from the upper surface of the water lock 22 and then can extend rearwardly downwardly. The downstream end of the exhaust pipe 22*a* can pass through the casing and can join the water outlet port of the propulsion unit 21.

Figure 3:
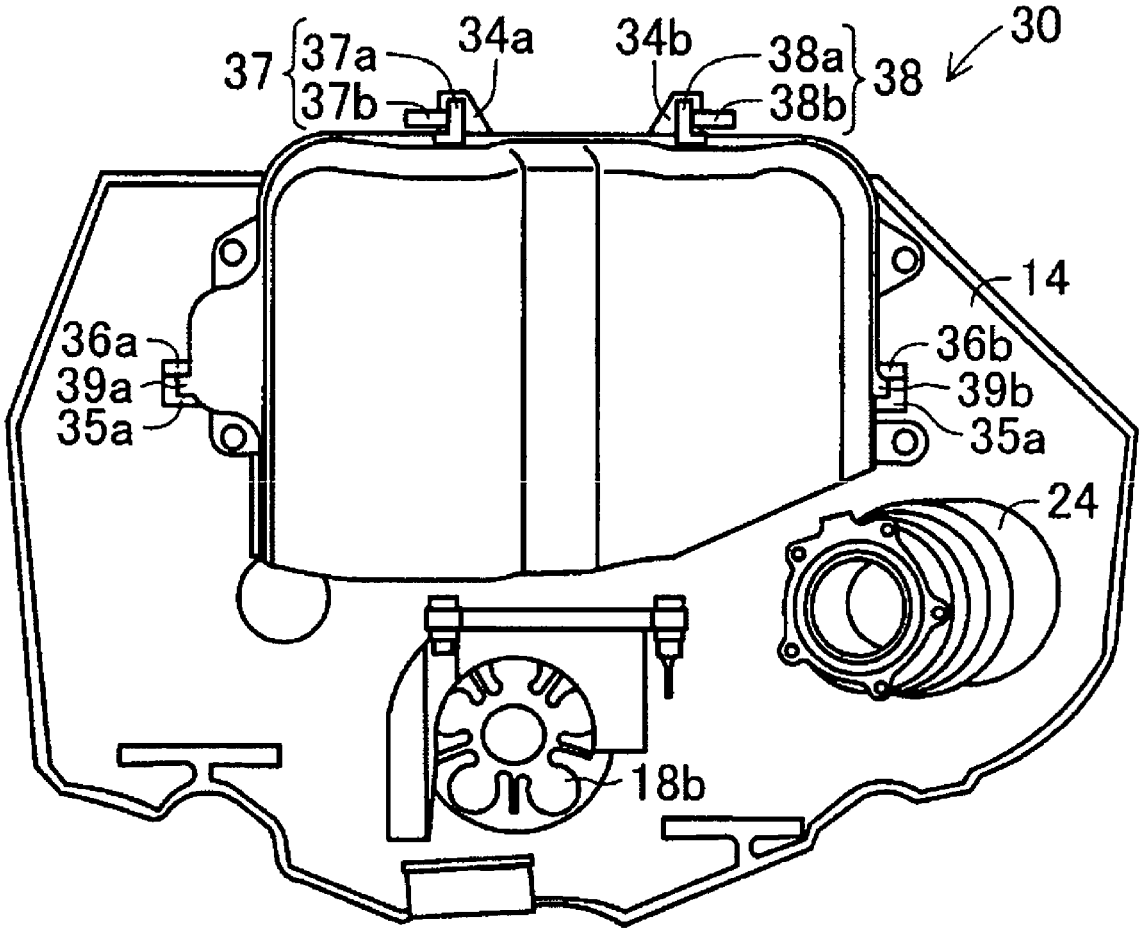
FIG. 3 is a front view of the electrical component box disposed on a bulkhead removed from the water vehicle, as viewed from a front side of the bulkhead.
Figure 4:
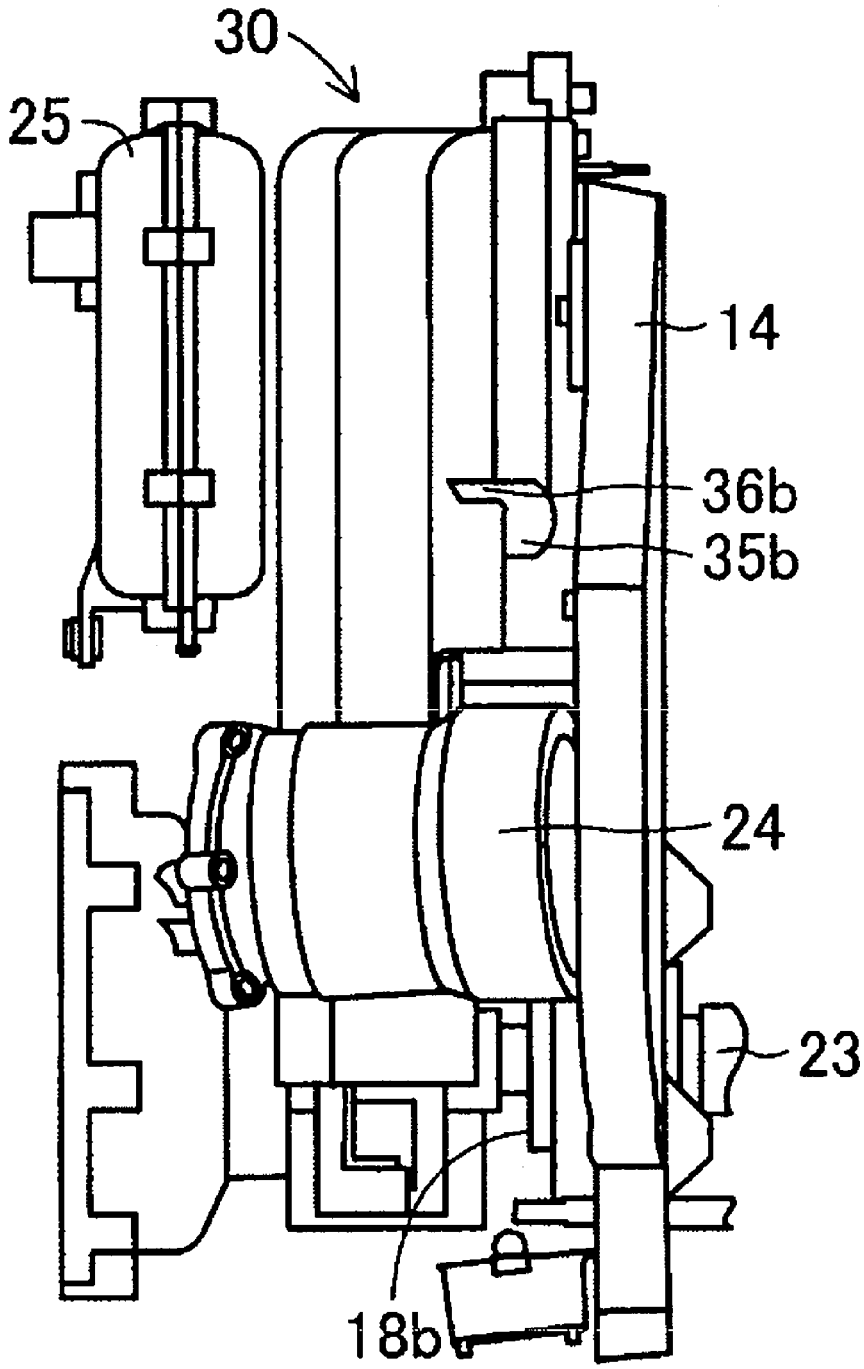
FIG. 4 is a side elevational view of the electrical component box disposed on the bulkhead.
Figure 5:
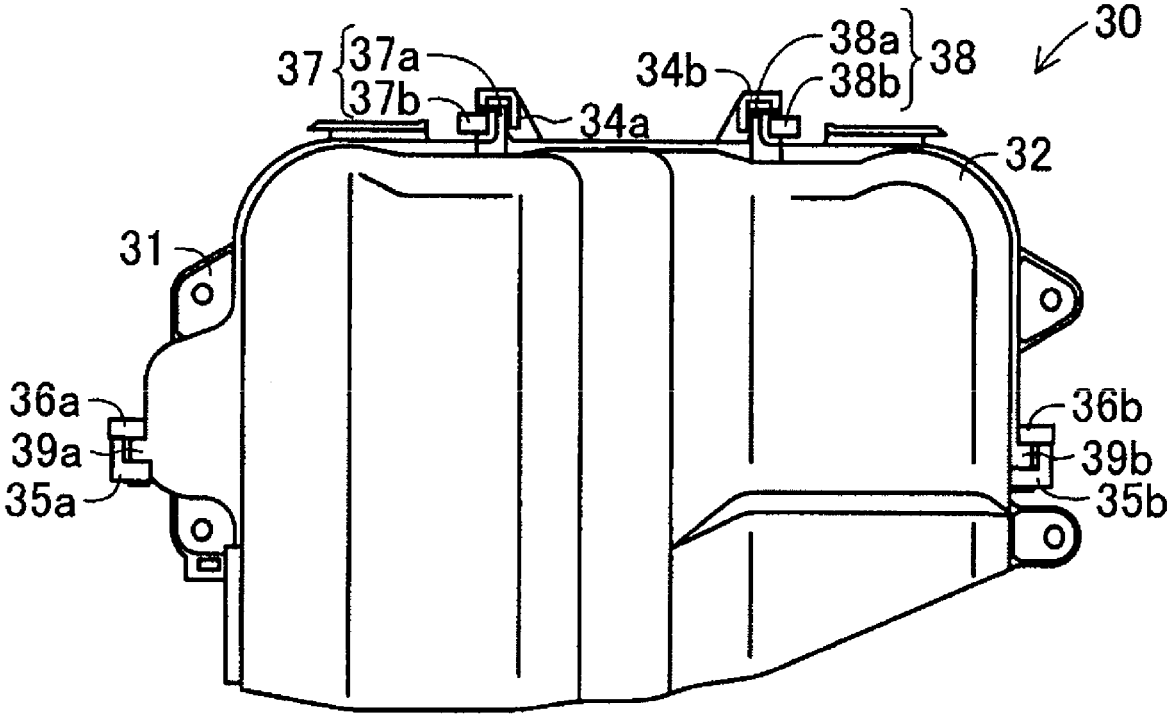
FIG. 5 is an enlarged front elevational view of the electrical component box removed from the bulkhead.
Figure 6:
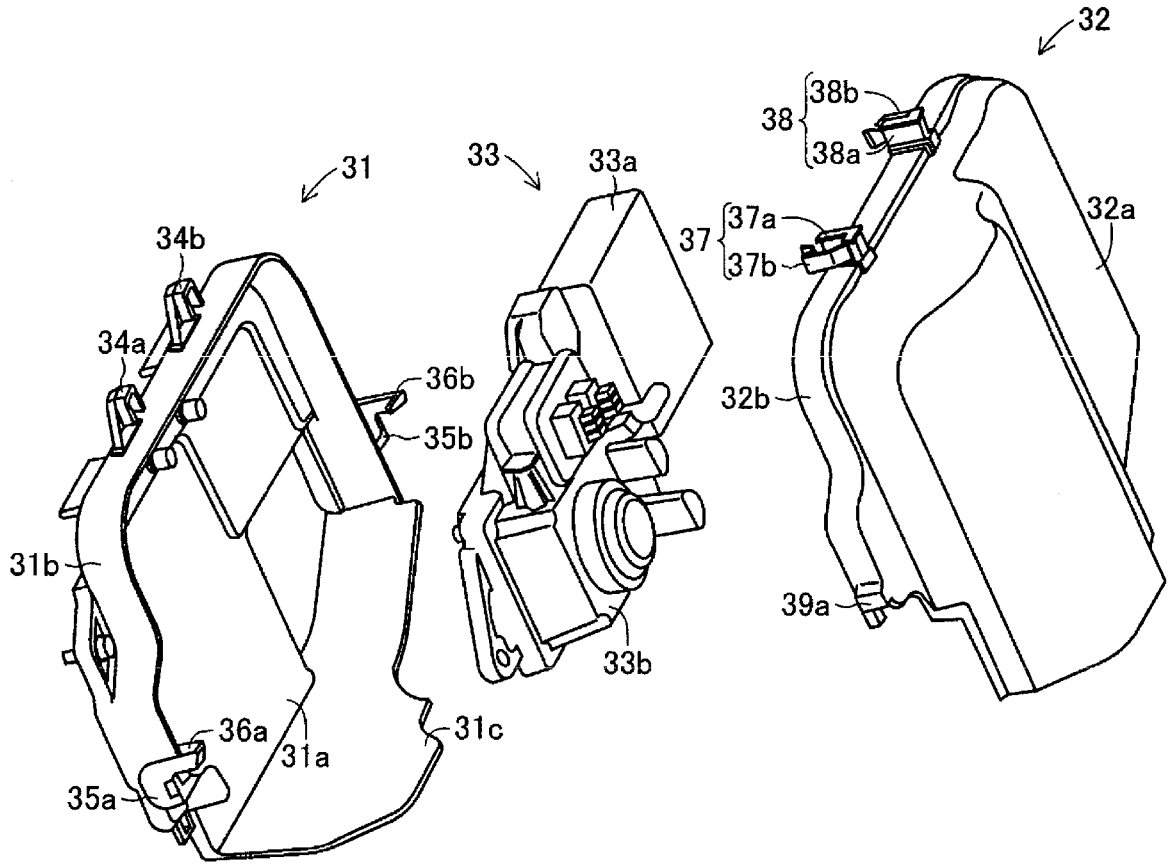
FIG. 6 is an exploded perspective view of the electrical component box.

On the engine compartment 15 side surface of the bulkhead 14, there can be provided the electrical component box 30 as shown in FIGS. 3 and 4. As shown in FIGS. 5 and 6, the electrical component box 30 can include a box body 31 and a cover member 32 and can be used to contain an electrical unit 33 therein. The electrical unit 33 can include an electrical control device 33*a* which can comprise CPUs, ROMs, RAMs, timers and the like and various electrical components 33*b*. These components can be used to implement various processes related to an operation of the water vehicle 10.

With continued reference to FIG. 6, the box body 31 can include a base part 31*a*, which can be generally flat, a peripheral wall part 31*b* formed along the periphery of the base part 31*a*. In some embodiments, the peripheral wall part 31*b* does not extend along a lower part of the body 31. Additionally, the body 31 can include a bottom cover 31*c* formed on the lower periphery of the base part 31*a*.

A surface (inner surface) of the base part 31*a* can be a surface be configured to provide a mounting surface for the electrical unit and can be formed with a plurality of stepped planes to accommodate the shapes of the outer surfaces of the electrical unit 33 for attachment thereof. The peripheral wall part 31*b* can be formed by a wall of a small width (length in a longitudinal direction). Additionally, the bottom cover 31*c* can be formed by a wall of a large width. The bottom cover 31*c* can be shaped to cover the bottom face of the electrical unit 33 as seen from below. However, other configurations can also be used.

In some embodiments, on the upper surface of the peripheral wall part 31*b*, there can be provided engaging frames 34*a*, 34*b*, which can be considered as providing "engaged portions". The engaging frames 34*a*, 34*b* can be spaced apart from each other in a lateral direction.

The engaging frames 34*a*, 34*b* can have a gate-shaped through-hole in a fore-and-aft direction as viewed from front. As viewed in plan, left and right corners (a left lower corner of the engaging frame 34*a* and a right upper corner of the engaging frame 34*b* in FIG. 5) of the outer surface in the rear part of the rectangle (rear side of the body box 31) can be cut and slanted. In the lower part of both left and right sides of the peripheral wall part 31*b*, there can be respectively provided engaging grips 35*a*, 35*b* and guide parts 36*a*, 36*b*, which can serve as "sub-engaged portions". However, other configurations can also be used.

Figure 7:
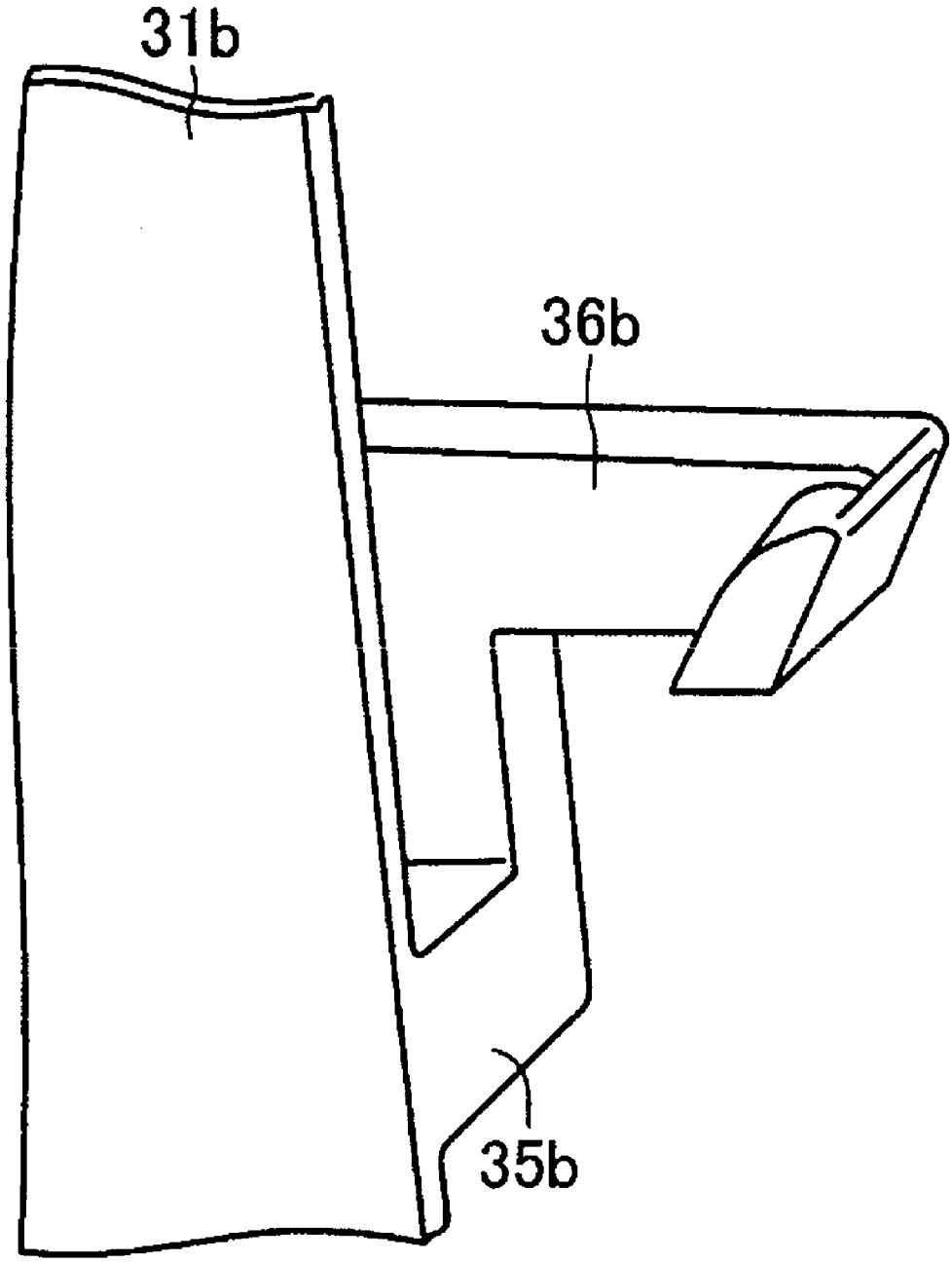
FIG. 7 is an enlarged perspective view of an engaging grip and a guide part of the electrical component box.
Figure 8:
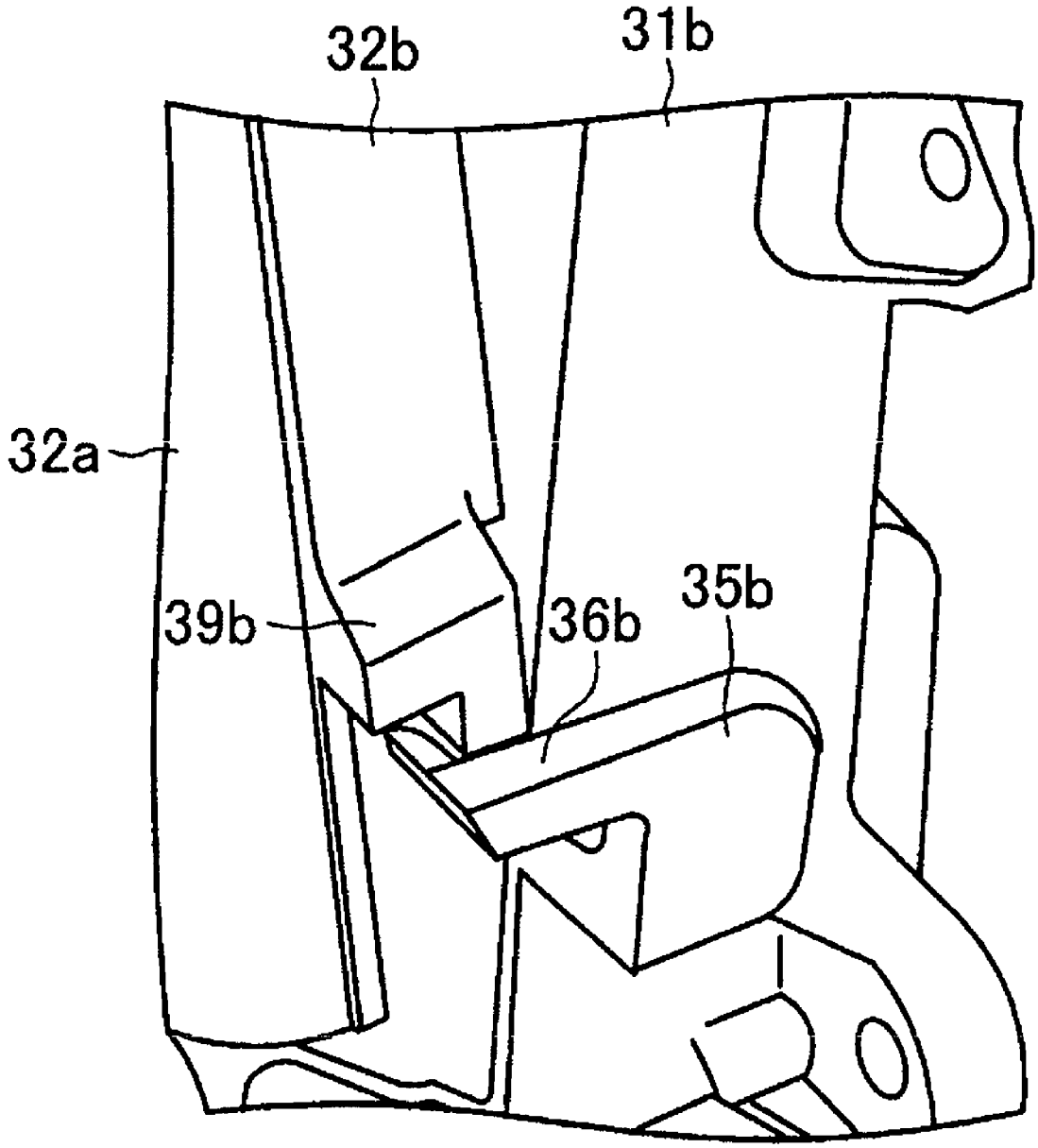
FIG. 8 is a perspective view of the engaging grip and an engaging projection in a state just before being engaged.

As shown in FIGS. 7 and 8, in some embodiments, the engaging grip 35*b* and the guide part 36*b* can be formed integrally. The engaging grip 35*b* can be formed in L shape by a horizontal piece extending horizontally from the surface of the peripheral wall part 31*b* and a vertical piece extending generally upwardly in parallel with the surface of the peripheral wall part 31*b* from the distal end of the horizontal piece. However, other configurations can also be used.

The guide part 36*b* can be formed by a projection which projects toward the front of the peripheral wall part 31*b* from the upper part of the engaging grip 35*b* while crossing perpendicularly with the vertical piece of the engaging grip 35*b*. The distal end surface of the guide part 36*b* can be formed in a broad slant projecting toward the peripheral wall part 31*b*. For example, on the inner surface of the distal end of the guide part 36*b*, a projection can be formed toward the peripheral wall part 31*b*. However, other configurations can also be used.

In some embodiments, the engaging grip 35*a* and the guide part 36*a* can also be formed integrally. Both pairs of engaging grips 35*a*, 35*b* and guide parts 36*a*, 36*b* can be symmetrically formed. That is, the engaging grip 35*a* and the guide part 36*a* can be formed integrally.

The engaging grip 35*a* can be formed in L shape by a horizontal piece extending horizontally from the surface of the peripheral wall part 31*b* and a vertical piece extending upward in parallel with the surface of the peripheral wall part 31*b* from the distal end of the horizontal piece. The guide part 36*a* can be formed by a projection which projects toward the front of the peripheral wall part 31*b* from the upper part of the engaging grip 35*a* while crossing perpendicularly with the vertical piece of the engaging grip 35*a*. The distal end surface of the guide part 36*a* can be formed in a broad slant projecting toward the peripheral wall part 31*b*. On the inner surface of the distal end of the guide part 36*a*, a projection can be formed toward the peripheral wall part 31*b*. However, other configurations can also be used.

With reference again to FIG. 6, the cover member 32 can include a cover part 32*a* formed in a curved plate and a peripheral wall part 32*b* formed along the periphery of the cover part 32*a*. In some embodiments, the peripheral wall part 32*b* does not extend along the lower part of the cover member 32.

In some embodiments, the cover part 32*a* can cover the upper and both lateral sides of the electrical unit 33 and can be formed to accommodate the shapes of the outer surfaces of the electrical unit 33. The cover part 32*a* can be formed thicker than the base part 31*a* of the box body 31. Accordingly, when the cover member 32 can be attached to the box body 31, the lower end of the cover part 32*a* can be positioned lower than the bottom cover 31*c*. In this regard, there can be formed a small gap between the inner periphery of the cover part 32*a* and the outer periphery of the bottom cover 31*c*.

The peripheral wall part 32*b* can be formed slightly larger than the peripheral wall part 31*b* of the box body 31 as a whole. When the cover member 32 is attached to the box body 31, the inner periphery of the peripheral wall part 32*b* surrounds the outer periphery of the peripheral wall part 31*b* thereby covering the front part of the peripheral wall part 31*b*. On the upper surface of the peripheral wall part 32*b*, there can be provided engaging clamps 37, 38, which can serve as an "engaging portions", disposed apart from each other to be engaged with the engaging frames 34*a*, 34*b*.

With reference to FIG. 5, the engaging clamp 37 can be formed by an inserting projection 37*a* and an elastic hook 37*b*. The inserting projection 37*a* can be adapted to be inserted into the engaging frame 34*a*. The elastic hook 37*b* can curve and extend from the outer surface (the left lower face in FIG. 5) at the base end of the inserting projection 37*a* toward the distal end of the inserting projection 37*a*. The distal end of the elastic hook 37*b* can be adapted to be engaged with the rear slanted part of the engaging frame 34*a*.

The engaging clamp 38 can be formed by an inserting projection 38*a* and an elastic hook 38*b*. The inserting projection 38*a* can be adapted to be inserted into the engaging frame 34*b*. The elastic hook 38*b* can curve and extend from the outer surface (the right upper face in FIG. 5) at the proximal end of the inserting projection 38*a* toward the distal end of the inserting projection 38*a*.

The distal end of the elastic hook 38*b* can be adapted to be engaged with the rear slanted part of the engaging frame 34*b*. The elastic hook 37*b* can engage with the rear part of the engaging frame 34*a* by pushing its distal end to the slanted part of the engaging frame 34*a* guided through the outer side of the engaging frame 34*a* and clamps the slanted part of the engaging frame 34*a* with the inserting projection 37*a*.

Likewise, the elastic hook 38*b* engages with the rear part of the engaging frame 34*b* by pushing its distal end to the slanted part of the engaging frame 34*b* guided through the outer side of the engaging frame 34*b* and clamps the slanted part of the engaging frame 34*b* with the inserting projection 38*a*. In the lower part of both left and right sides of the peripheral wall part 32*b*, there can be respectively provided engaging projections 39*a*, 39*b*, which can serve as "sub-engaging portions".

The engaging projection 39*a*, which can be formed in an L-shaped projection to be engaged with the engaging grip 35*a*, can be formed by a generally-square base part protruding from the surface of the peripheral wall part 32*b* and a projecting part projecting downward from the periphery of the peripheral wall part 32*b* at the outside of the lower face of the base part. However, other configurations can also be used.

Also, the engaging projection 39*b*, which can be formed in an L-shaped projection to be engaged with the engaging grip 35*b*, can be formed by a generally-square base part protruding from the surface of the peripheral wall part 32*b* and a projecting part projecting downward from the periphery of the peripheral wall part 32*b* at the outside of the lower face of the base part. The engaging projections 39*a*, 39*b* can be formed symmetrically with respect to each other. The upper faces of the engaging projections 39*a*, 39*b* can be slanted with their distal ends positioned lower.

As a result, when the cover member 32 is moved downwardly with respect to the box body 31 while keeping respective contact between the lower ends of the engaging projections 39*a*, 39*b* and the rear parts of the engaging grips 35*a*, 35*b*, both lower ends of the engaging projections 39*a*, 39*b* respectively become engaged with the rear parts of the engaging grips 35*a*, 35*b*. In this regard, the projection in the distal end surface of the guide part 36*a* projecting toward the peripheral wall part 31*b* contacts with the rear part (L-shaped part) of the engaging projection 39*a* to guide the lower end of the engaging projection 39*a* to be engaged with the rear part of the engaging grip 35*a* in a proper state.

Figure 9:
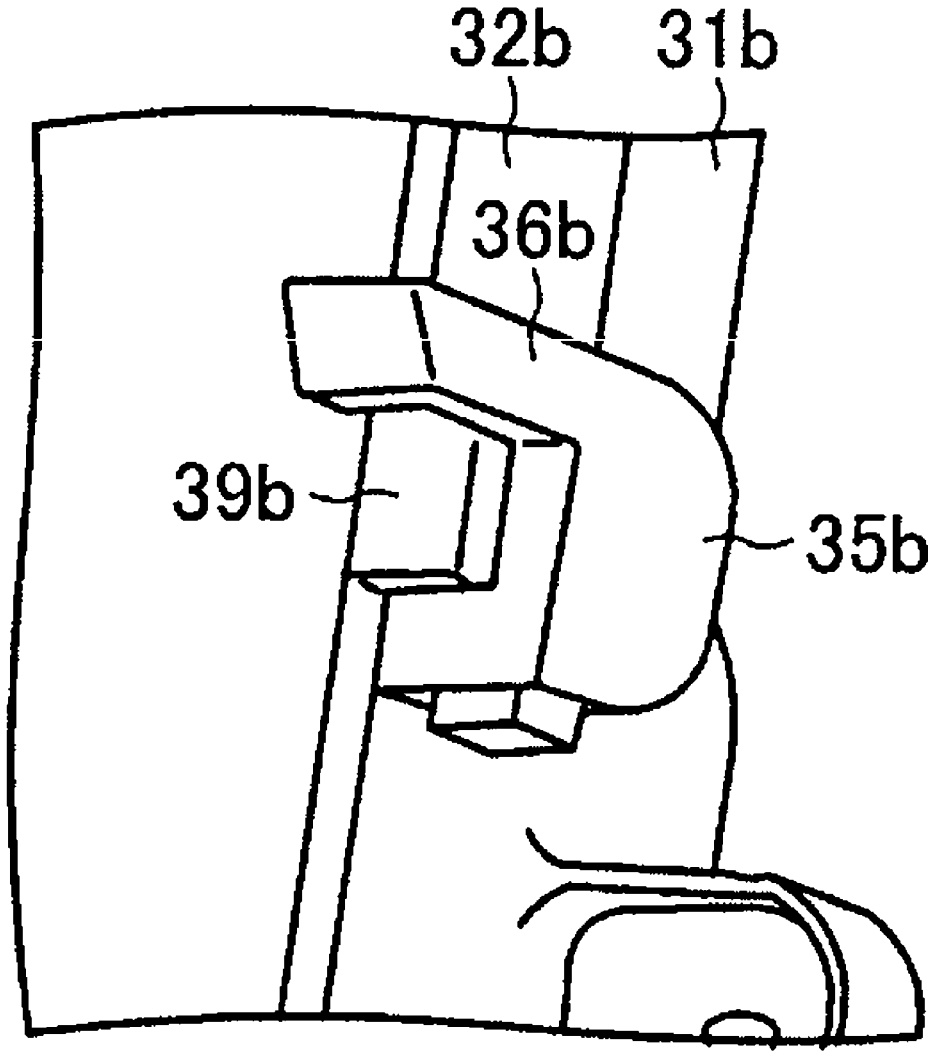
FIG. 9 is a perspective view of the engaging grip and an engaging projection in a state of being engaged.

Also, the projection in the distal end surface of the guide part 36*b* projecting toward the peripheral wall part 31*b* contacts with the rear part (L-shaped part) of the engaging projection 39*b* to guide the lower end of the engaging projection 39*b* to be engaged with the rear part of the engaging grip 35*b* in a proper state. Accordingly, as shown in FIG. 9, the engaging projections 39*a*, 39*b* respectively engage with the engaging grips 35*a*, 35*b* and the cover member 32 can be positioned in place with respect to the box body 31.

Figure 10:
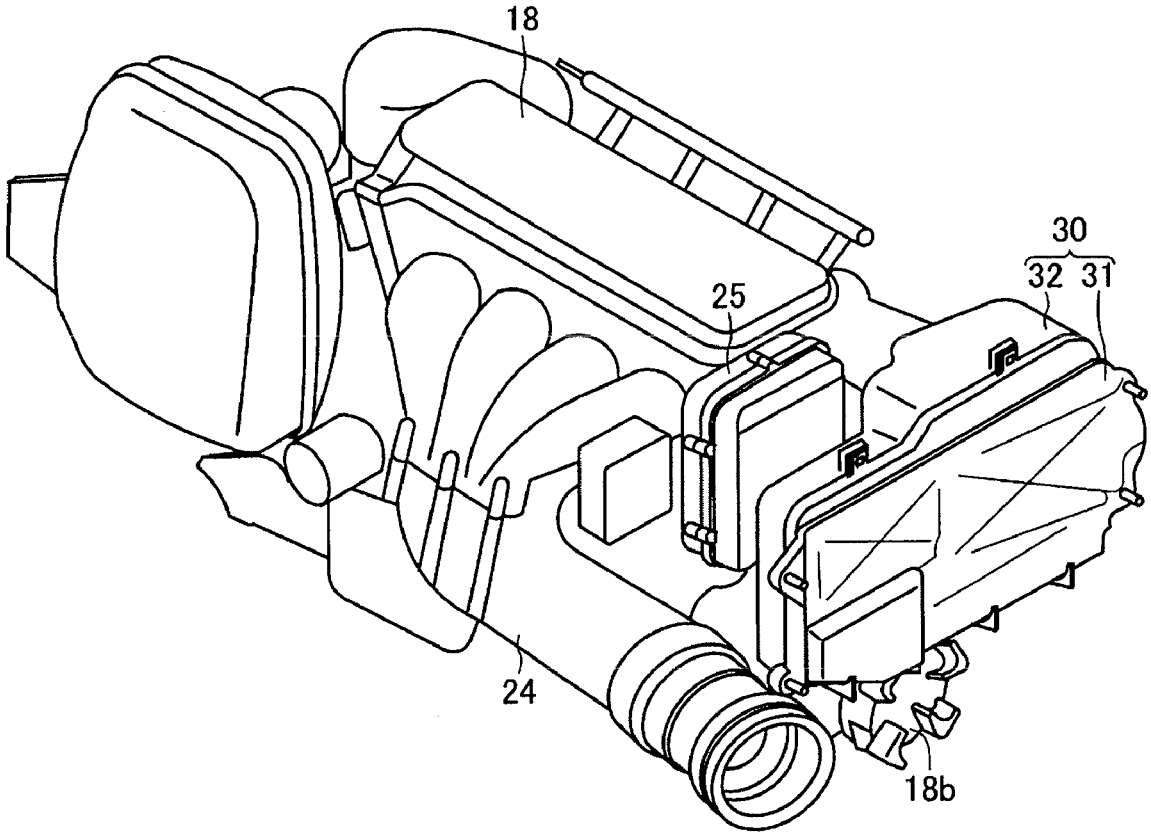
FIG. 10 is a perspective view illustrating an arrangement of the electrical component box and an engine.

As shown in FIGS. 3 and 4, the electrical component box 30 can be configured in such a manner described above and installed on the bulkhead 14 above the coupling 18*b*. As viewed from the bulkhead 14 side in FIG. 10, the electrical component box 30 can be positioned close to a breather case 25 provided behind the engine 18. As shown in FIGS. 2, 11, 12 and 13, under the seat 13 in the body 11, there can be provided a maintenance opening 26 in a longitudinally longer elliptical shape.

Figure 11:
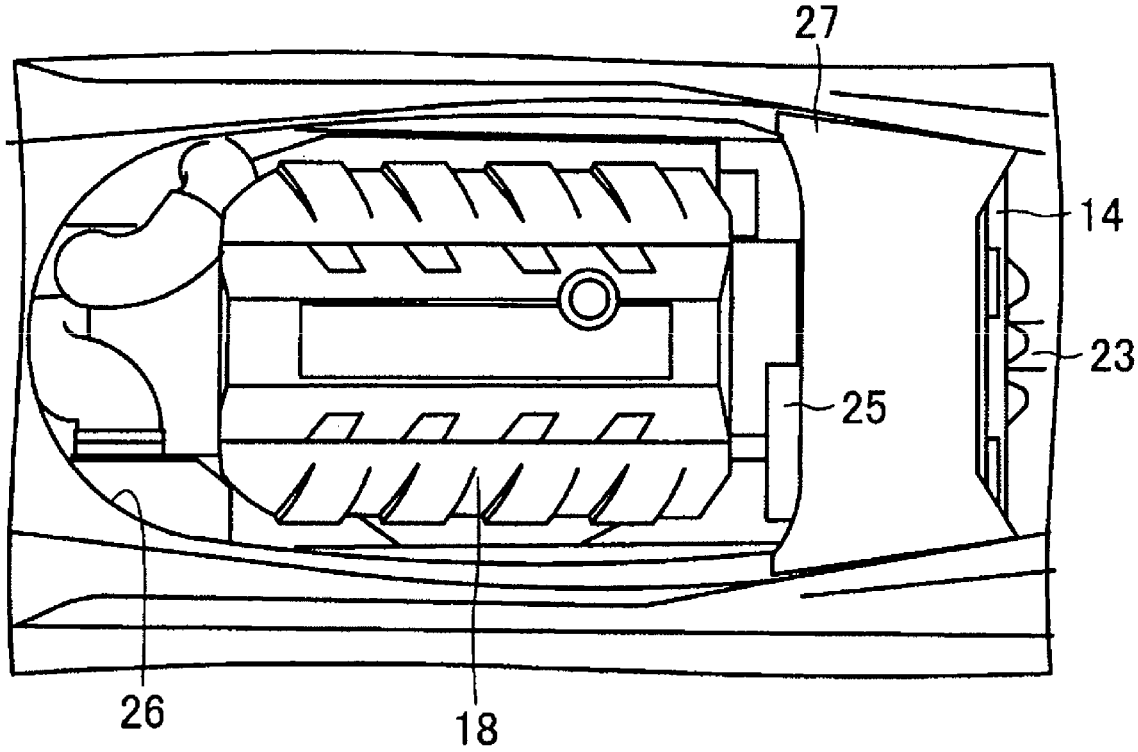
FIG. 11 is a plan view of a maintenance opening of the water vehicle with a cross beam in place.
Figure 12:
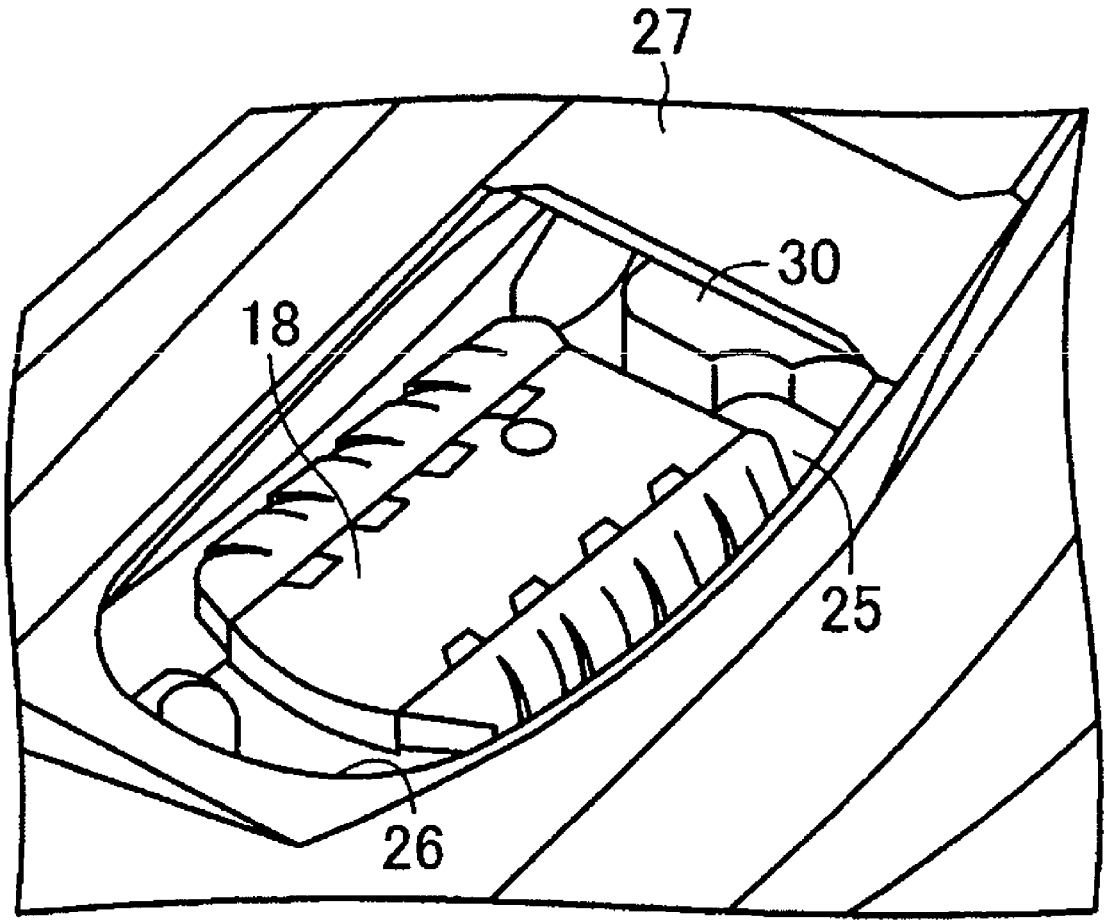
FIG. 12 is a perspective view of the maintenance opening.
Figure 13:
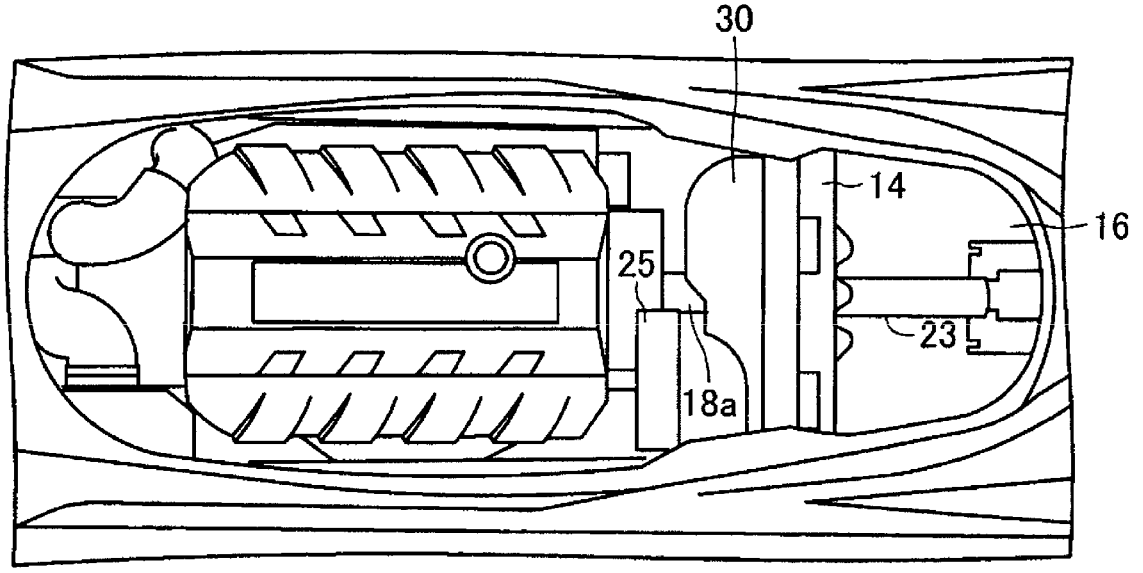
FIG. 13 is a plan view of the maintenance opening with the cross beam removed.

As shown in FIG. 11, a cross beam 27 can be disposed in a part slightly rearward of the center of the maintenance opening 26 and can extend in the lateral direction. The electrical component box 30 can be positioned below the cross beam 27. FIG. 13 shows the maintenance opening 26 without the cross beam 27.

The seat 13 can be detachable. As such, the maintenance opening 26 becomes accessible by removing the seat 13, or pivoting the seat 13 about its front end. A gap can be provided so as to allow a worker to insert his/her hand between the upper surface of the electrical component box 30 and the cross beam 27.

In this configuration, when attaching the cover member 32 to the box body 31 positioned on the bulkhead 14, firstly the maintenance opening 26 can be kept open by removing or pivoting the seat 13 aside. Then, the cover member 32 can be inserted into the gap between the box body 31 and the cross beam 27 from the rear side of the maintenance opening 26 in such a manner that the cover member 32 is held generally vertical and its front surface can be kept facing upwardly.

Figure 14:
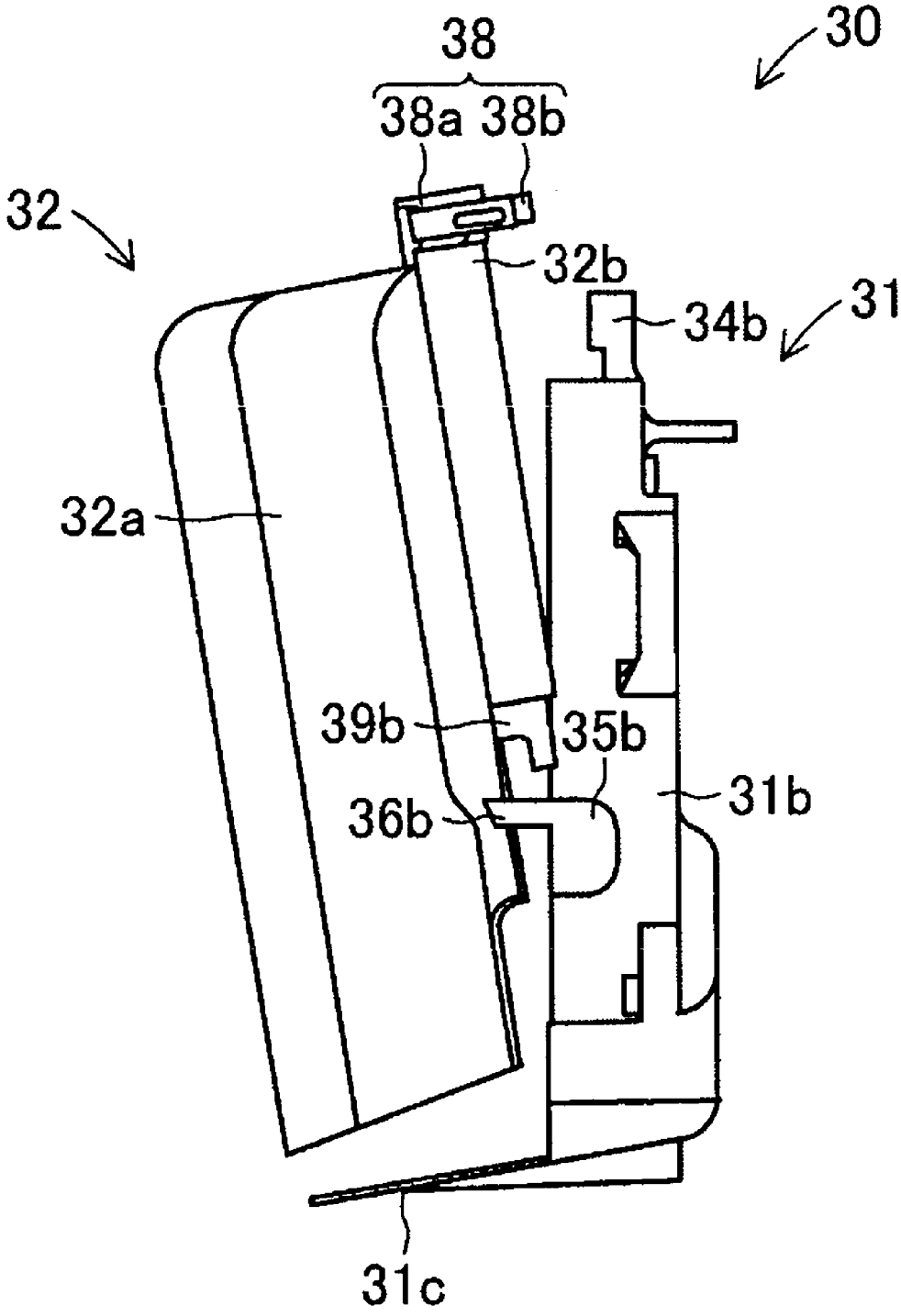
FIG. 14 is a side elevational view of the electrical component box with its cover member moved close to the upper surface of a box body, which can be an initial phase of a process of installing the cover onto the body.
Figure 15:
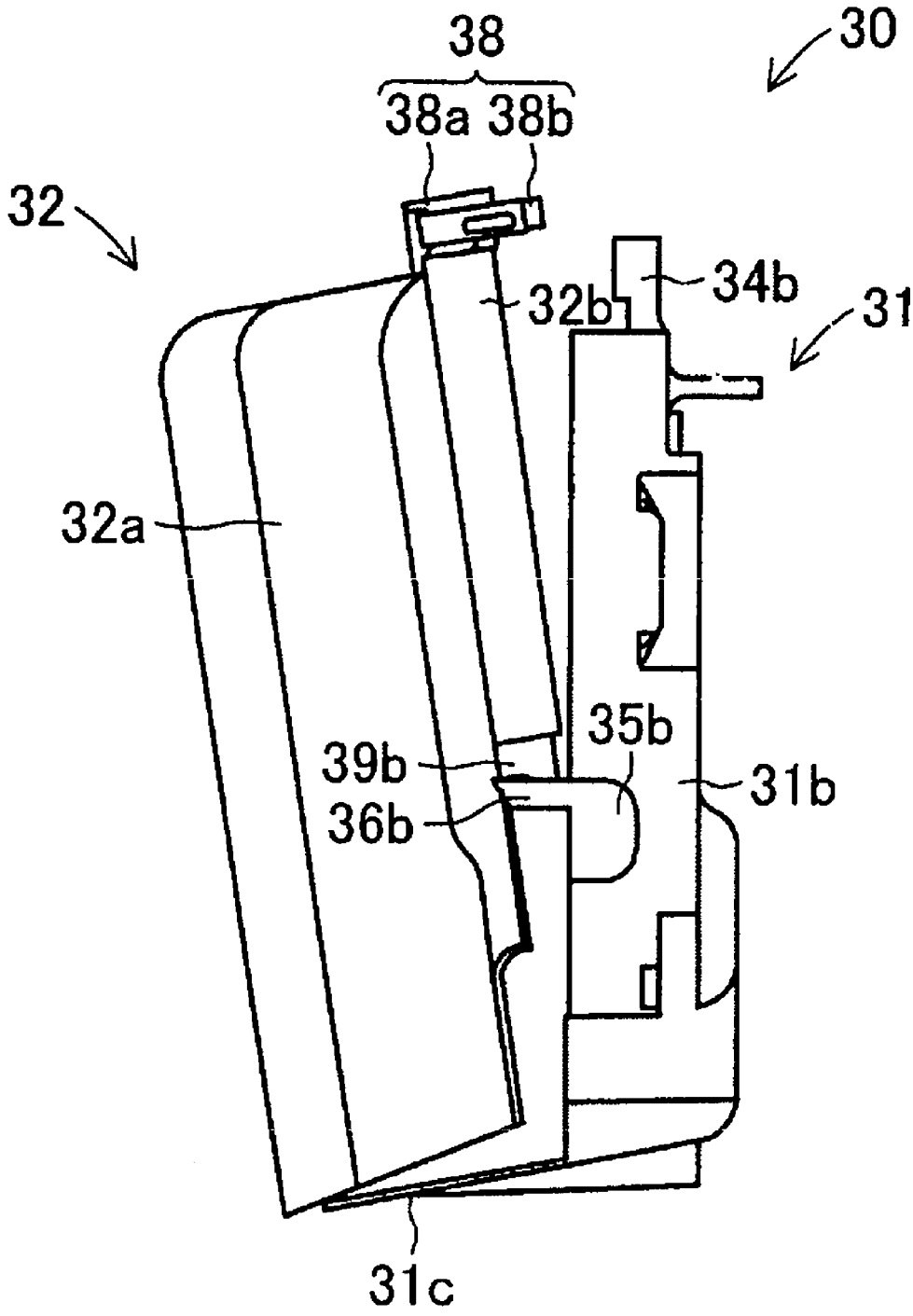
FIG. 15 is another side elevational view of the electrical component box in a state in which the engaging projection of the cover member contacts with the engaging grip of the box body.

With reference to FIG. 14, the cover member 32 can be then positioned above the front surface of the box body 31 while gradually slanting the posture of the cover member 32. Next, the cover member 32 can be moved downward in this state. Accordingly, as shown in FIG. 15, the lower ends of the engaging projections 39*a*, 39*b* respectively contact with the engaging grips 35*a*, 35*b*.

Figure 16:
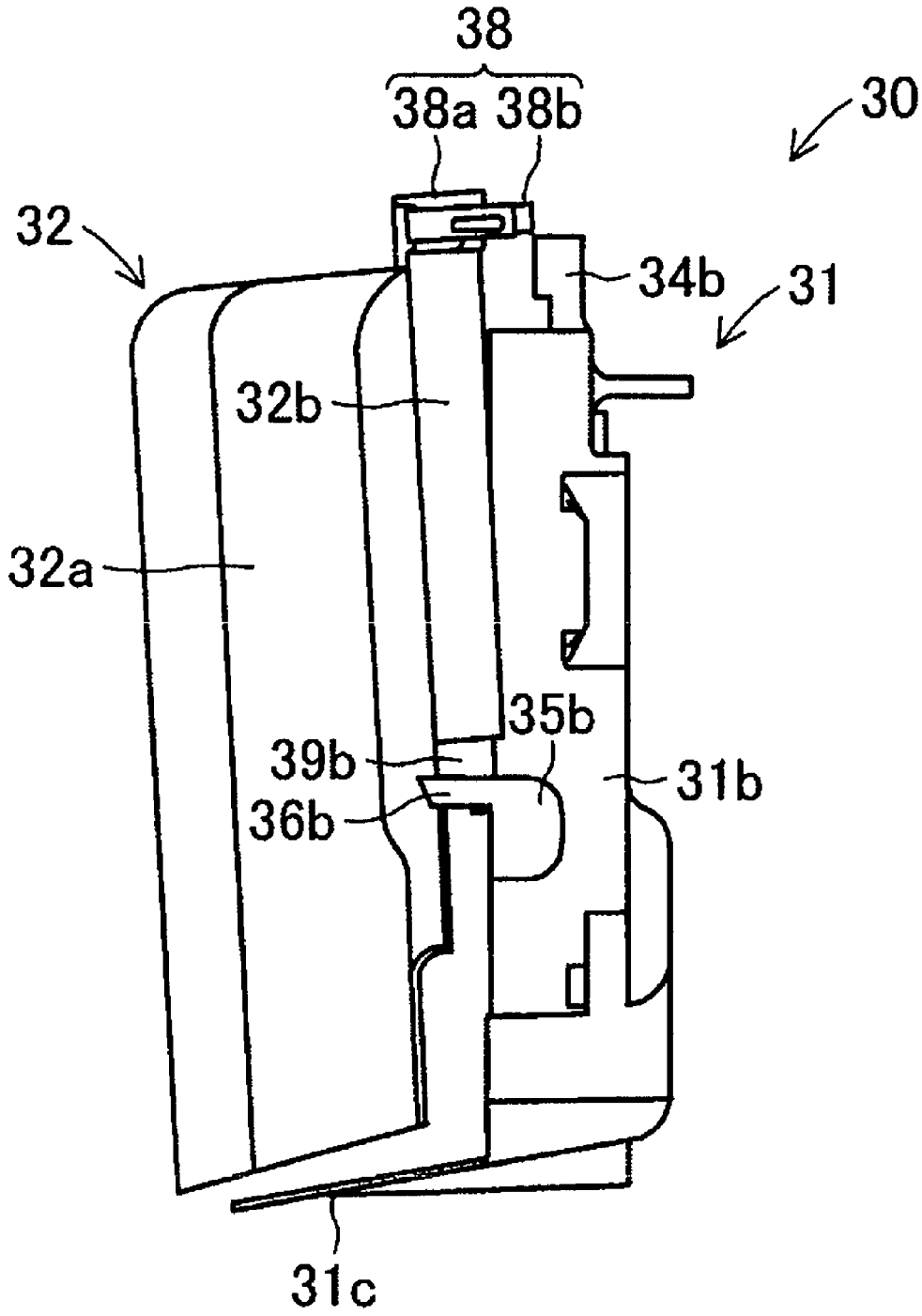
FIG. 16 is another side elevational view illustrating a state in which the engaging projection of the cover member is aligned above the engaging grip of the box body.
Figure 17:
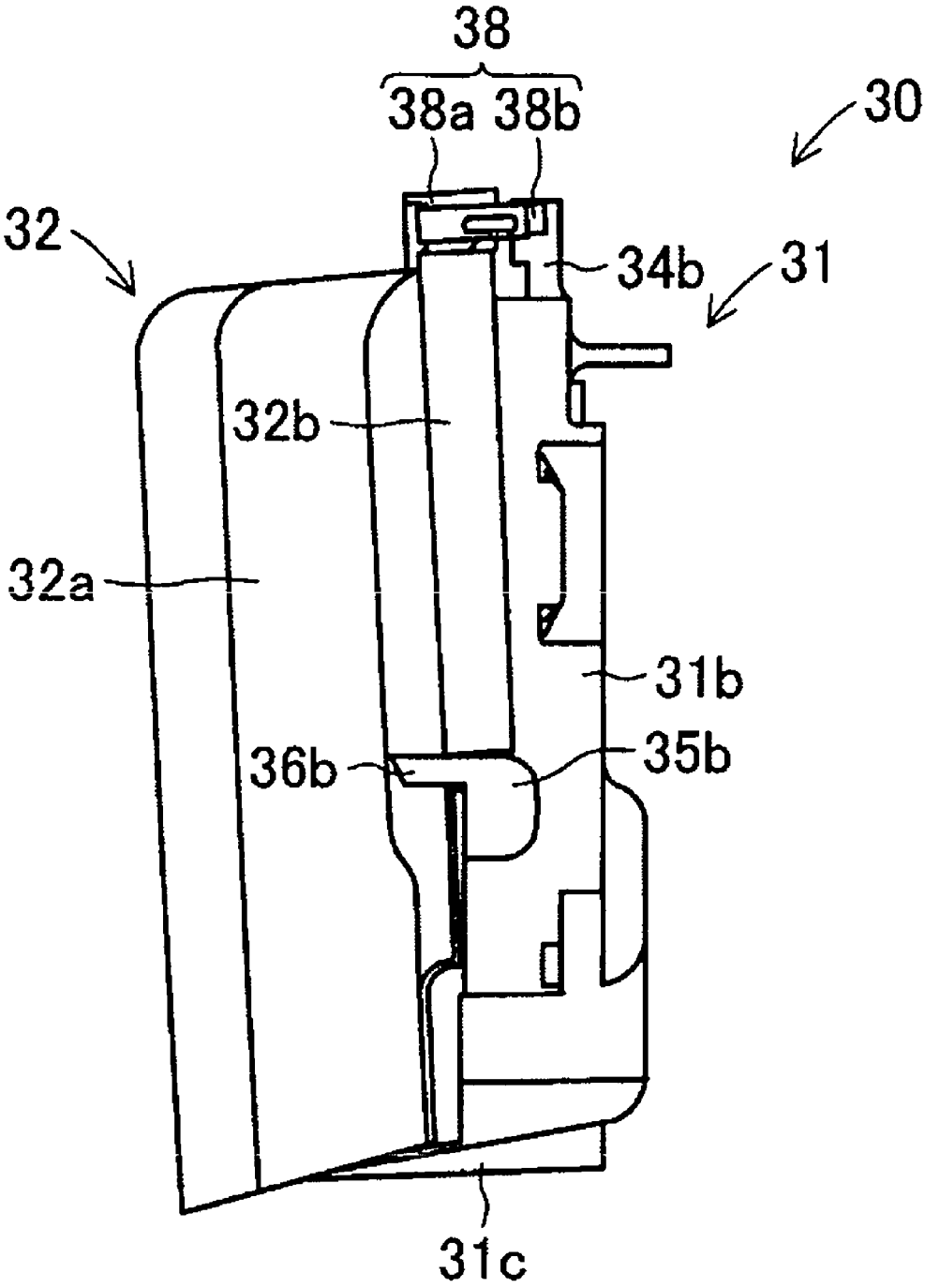
FIG. 17 is another side elevational view illustrating a state in which the engaging projection of the cover member begins to engage with the engaging grip of the box body.
Figure 18:
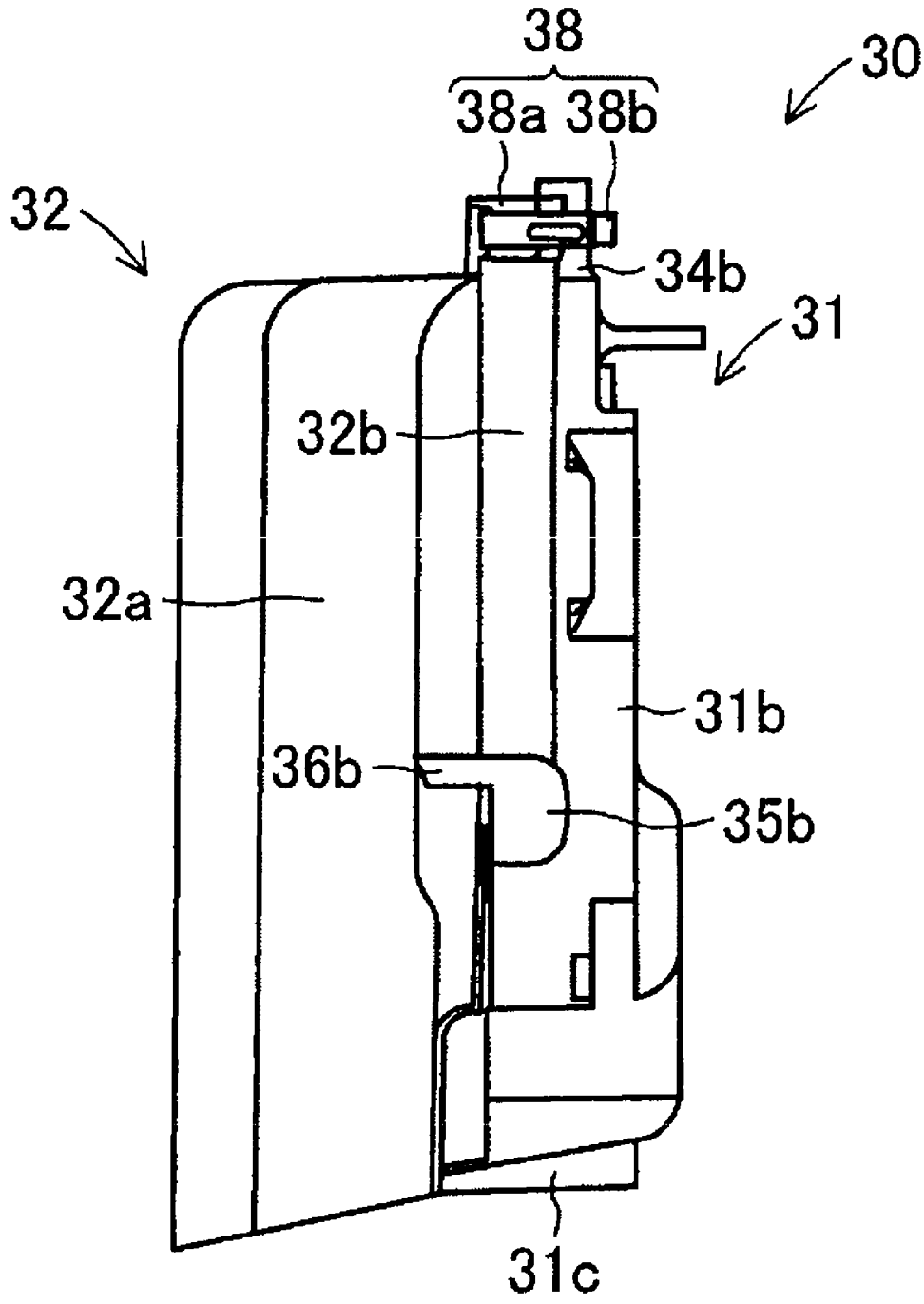
FIG. 18 is another side elevational view illustrating a state in which the engaging projection of the cover member has been engaged with the engaging grip of the box body.

In this state, as shown in FIG. 16, when the cover member 32 is pressed to the front surface side of the box body 31, the engaging projections 39*a*, 39*b* are respectively positioned above the engaging grips 35*a*, 35*b*. As shown in FIG. 17, when the cover member 32 is moved further downwardly, the projections in the distal end surfaces of the guide parts 36*a*, 36*b* contact with the rear parts (L-shaped part) of the engaging projections 39*a*, 39*b* to guide the engaging projections 39*a*, 39*b* to be engaged with the engaging grips 35*a*, 35*b* in a proper state When the cover member 32 is moved to its lowermost part, the engaging projections 39*a*, 39*b* respectively engage with the engaging grips 35*a*, 35*b* in a state as shown FIG. 18. In this state, the lower end of the cover member 32 can be positioned lower than the bottom cover 31*c* of the box body 31.

Figure 19:
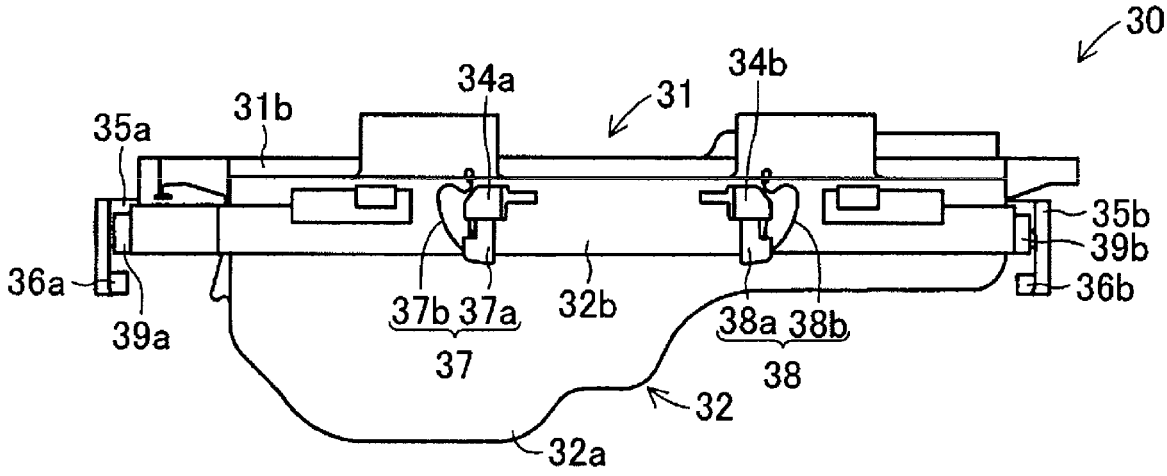
FIG. 19 is a top plan view of the electrical component box in the state illustrated in FIG. 18.
Figure 20:
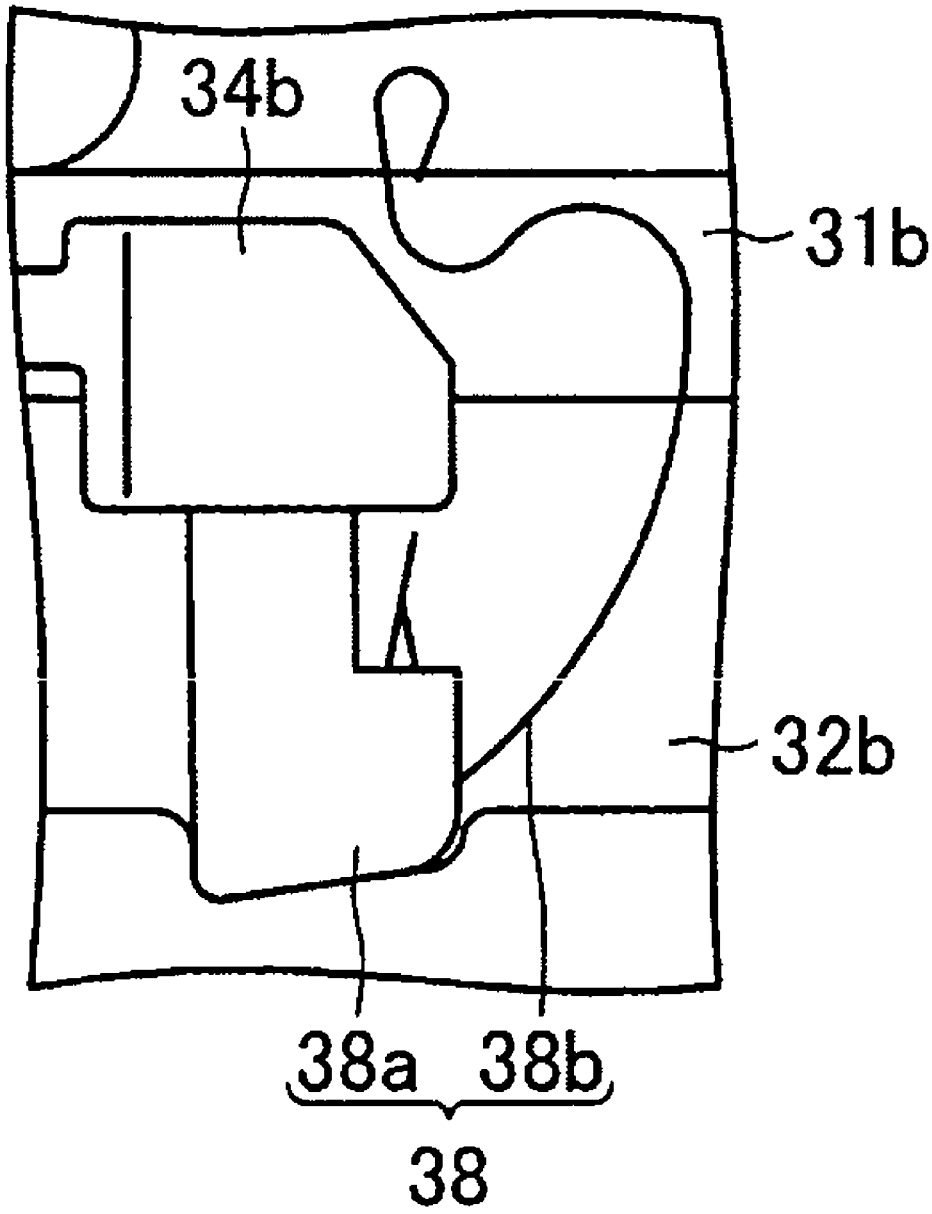
FIG. 20 is an enlarged view illustrating a relationship between an engaging frame and an engaging clamp of the electrical component box in FIG. 19.

FIG. 19 shows the upper face of the electrical component box 30 in this state. In this state, though the inserting projections 37*a*, 38*a* are respectively inserted into the engaging frames 34*a*, 34*b*, the engaging frames 34*a*, 34*b* are not engaged with the elastic hooks 37*b*, 38*b* (see FIG. 20).

Figure 21:
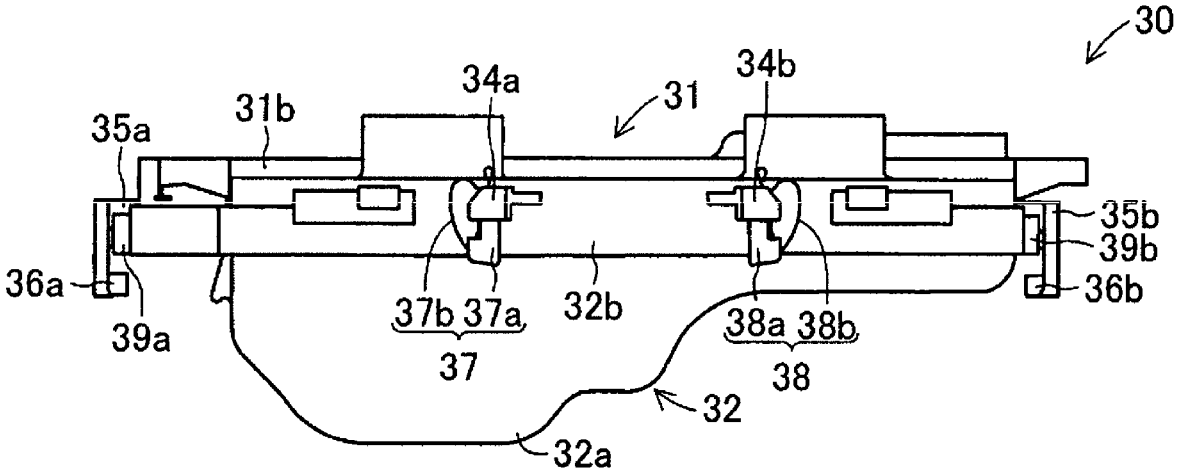
FIG. 21 is a top plan view illustrating a state in which the engaging frame and the engaging clamp of the electrical component box are engaged with each other.
Figure 22:
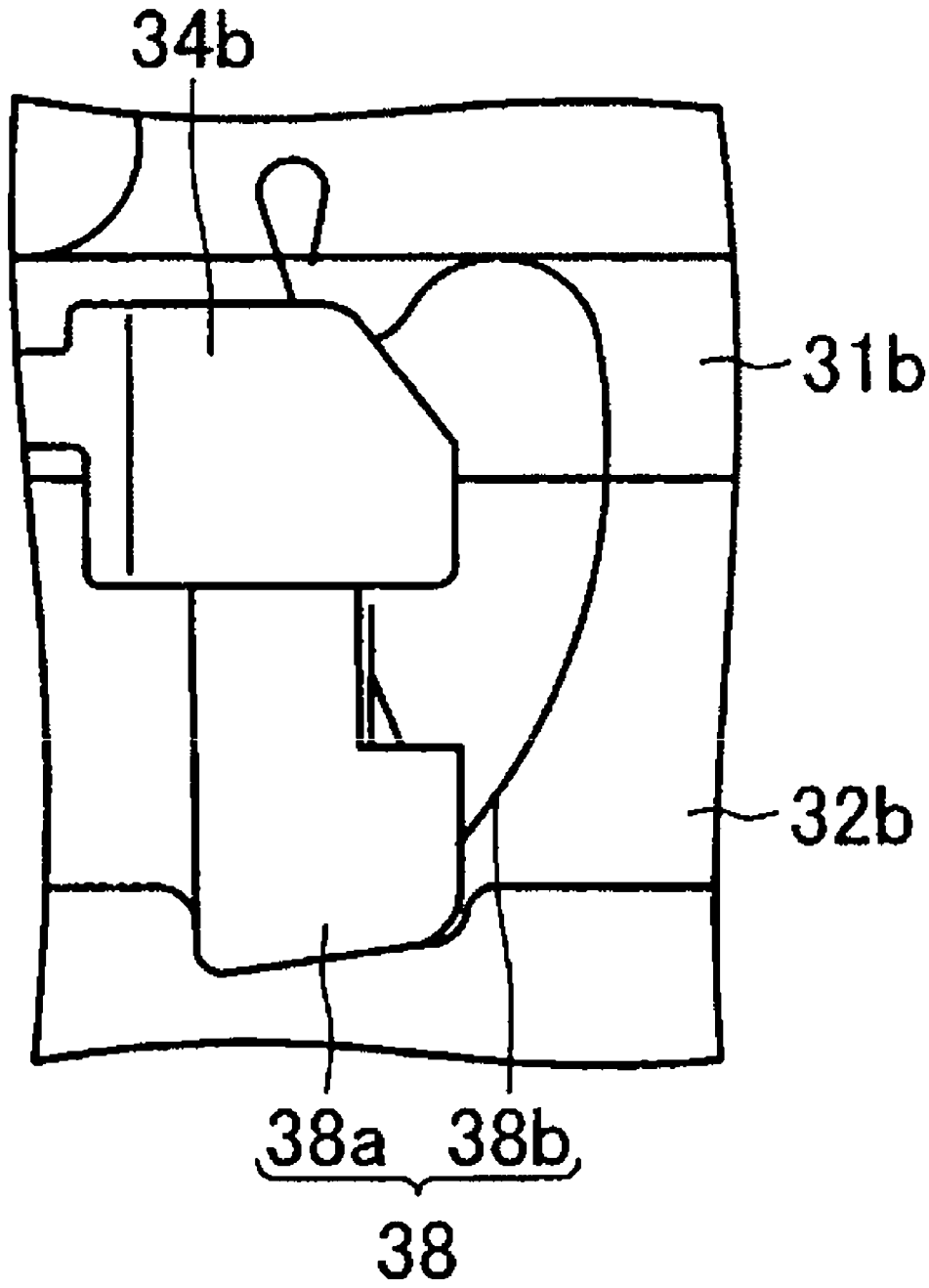
FIG. 22 is another enlarged view illustrating an engaging state of the engaging frame and the engaging clamp of the electrical component box in FIG. 21.

Pushing the elastic hooks 37*b*, 38*b*, as shown in FIG. 19, respectively to the right and to the left makes the engaging frames 34*a*, 34*b* engage respectively with the elastic hooks 37*b*, 38*b* and the engaging state is shown in FIGS. 21 and 22. Accordingly, attachment of the cover member 32 to the box body 31 can be completed. On the other hand, when the cover member 32 can be removed from the box body 31 for repair or maintenance of the electrical unit 33, the above described operations are executed in inverse order. After removing the cover member 32, a service personnel inserts his/her hand through the maintenance opening 26 into the engine compartment 15 to maintain the electrical unit 33.

Thus, in the electrical component box 30 according to some embodiments, the cover member 32 can be attached in such a manner that the cover member 32 can be moved downward with respect to the box body 31 from an upper position in which the box body 31, provided with the electrical unit 33, is attached to the bulkhead 14 in a generally vertical orientation. Then, the cover member 32 can be engaged with the box body 31 by engaging the engaging frames 34*a*, 34*b* with the engaging clamps 37, 38 by one-touch push operation of the elastic hooks 37*b*, 38*b* at a state in which the cover member 32 can be aligned with the box body 31.

Therefore, no tools such as a screwdriver or the like is needed for attaching and detaching the cover member 32, which makes operation simple and eliminates a need for extra space around the electrical component box 30 in which tools would otherwise be used. As a result, the engine 18 and the breather case 25 can be positioned close to the electrical component box 30 thereby reducing space around the engine compartment 15 and achieving a downsized water vehicle 10. Also, in the electrical component box 30 according some embodiments, the bottom side of the electrical unit 33 can be covered by the bottom cover 31*c* that can be provided under the box body 31 to which the electrical unit 33 can be attached and the upper side, both lateral sides and the front side of the electrical unit 33 are covered by the cover member 32.

Therefore, in some embodiments, no bottom is needed for the cover member 32. Accordingly, when the cover member 32 is moved downward with respect to the box body 31 from an upper position, the cover member 32 directly covers the upper side, both lateral sides and the front side of the electrical unit 33. Thus, an attachment operation of the cover member 32 becomes simpler. Also, when the cover member 32 is removed from the box body 31 during maintenance, there is nothing that covers the upper side, both lateral sides and the front side of the electrical unit 33, thereby facilitating an operation by hand through the maintenance opening 26 positioned at the upper part of the engine compartment 15.

Further, when the cover member 32 is attached to the box body 31, the lower end of the cover member 32 is positioned lower than the bottom cover 31*c*. Therefore, if water flows into the engine compartment 15 and drips on the cover member 32 of the electrical component box 30, no water enters inside the cover member 32. Accordingly, the electrical unit 33 can better protected from water. Since the engaging frames 34*a*, 34*b* are positioned on the upper face of the box body 31 and the engaging clamps 37, 38 are also positioned on the upper side of the cover member 32, checking the engaging frames 34*a*, 34*b* and the engaging clamps 37, 38 through the maintenance opening 26 as well as attaching/detaching of the cover member 32 to/from the box body 31 can become easier.

Further, since the engaging grips 35*a*, 35*b* and guide parts 36*a*, 36*b* can be provided on the peripheral wall part 31*b* of the box body 3 land the engaging projections 39*a*, 39*b* can be provided on the peripheral wall part 32*b* of the cover member 32 to be engaged with the engaging grips 35*a*, 35*b*, engagement between the cover member 32 and the box body 31 becomes more reliable. Also, since the guide parts 36*a*, 36*b* are provided, aligning the cover member 32 with the box body 31 can position be easier. Therefore, even if the engaging grips 35*a*, 35*b* and the engaging projections 39*a*, 39*b* are not in easily visible position through the maintenance opening 26, the engaging grips 35*a*, 35*b* can easily be engaged with the engaging projections 39*a*, 39*b*.

The present inventions are not limited to the embodiments described above and cab be practiced with various modifications. For example, the engaged portions and the engaging portions are not limited to the engaging frames 34*a*, 34*b* or the engaging clamps 37, 38. Other means for achieving attachment/detachment by simple operation without tools can also be employed. Also, the sub-engaged portions and the sub-engaging portions are not limited to shapes as the engaging grips 35*a*, 35*b* or the engaging projections 39*a*, 39*b*. Other shapes can be also used. Likewise, the shapes of the guide parts 36*a*, 36*b* can be changed to other shapes. Further, other parts which constitute the electrical component box can also be modified.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An electrical component box provided under a maintenance opening in an engine compartment on a water vehicle, comprising:

a box body attached to an attaching base in the engine compartment with its mounting surface, on which an electrical unit is mounted, extending generally vertically, the box body being provided with engaged portions at predetermined parts; and a cover member for covering the mounting surface on which the electrical unit is mounted in the box body, the cover member being provided with engaging portions at predetermined parts to be engaged with the engaged portions;

wherein the cover member is moved downward from an upper position of the box body to cover the mounting surface for the electrical unit and to be fixed onto the box body by movement of the engaging portions and the engaged portions toward each other.

2. The electrical component box for the water vehicle according to claim 1, wherein the cover member covers an upper side, both lateral sides and a front side of the electrical unit mounted on the mounting surface in the box body and the box body is provided with a bottom cover which covers a lower side of the electrical unit mounted on the mounting surface.

3. The electrical component box for the water vehicle according to claim 2, wherein when the cover member is attached to the box body, the lower end of the cover member being positioned lower than the peripheral part of bottom cover.

4. The electrical component box according to claim 2, wherein when the cover member is attached to the box body, the lower end of the cover member being positioned lower than the peripheral part of bottom cover.

5. The electrical component box for the water vehicle according to claim 1, wherein the engaged portions are provided on the upper part of the box body and the engaging portions are provided on the upper part of the cover member.

6. The electrical component box for the water vehicle according to claim 1, wherein the engaged portions and the engaging portions are formed by a lock mechanism which includes a hook and a hook receiver having elasticity to be engaged with the hook.

7. The electrical component box for the water vehicle according to claim 1, wherein sub-engaged portions are provided at both sides of the box body, sub-engaging portions are provided at both sides of the cover member to be engaged with the sub-engaged portions, and guide parts for guiding the sub-engaging portions with respect to the sub-engaged portions are provided in at least one of the box body and the cover member.

8. The electrical component box for the water vehicle according to claim 1, wherein the attaching base to which the electrical component box is attached is a rear wall of the engine compartment.

9. The electrical component box according to claim 1, wherein the cover member covers an upper side, both lateral sides and a front side of the electrical unit mounted on the mounting surface in the box body and the box body is provided with a bottom cover which covers a lower side of the electrical unit mounted on the mounting surface.

10. The electrical component box according to claim 1, wherein the engaged portions are provided on the upper part of the box body and the engaging portions are provided on the upper part of the cover member.

11. The electrical component box according to claim 1, wherein the engaged portions and the engaging portions are formed by a lock mechanism which includes a hook and a hook receiver having elasticity to be engaged with the hook.

12. The electrical component box according to claim 1, wherein sub-engaged portions are provided at both sides of the box body, sub-engaging portions are provided at both sides of the cover member to be engaged with the sub-engaged portions, and guide parts for guiding the sub-engaging portions with respect to the sub-engaged portions are provided in at least one of the box body and the cover member.

13. The electrical component box according to claim 1, wherein the attaching base to which the electrical component box is attached is a rear wall of the engine compartment.

* * * * *